US008333602B2

(12) United States Patent
Galluccio et al.

(10) Patent No.: US 8,333,602 B2
(45) Date of Patent: Dec. 18, 2012

(54) LAMP SOCKET HAVING A ROTOR

(75) Inventors: Gregory Galluccio, Hauppauge, NY (US); Anthony Tufano, Massapequa, NY (US); Francisco Schapira, Valley Stream, NY (US); Carlos Salazar, North Babylon, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 97 days.

(21) Appl. No.: 12/985,768

(22) Filed: Jan. 6, 2011

(65) Prior Publication Data

US 2012/0178311 A1 Jul. 12, 2012

(51) Int. Cl.
*H01R 33/02* (2006.01)

(52) U.S. Cl. ..... 439/241; 439/699.2

(58) Field of Classification Search ..... 439/226, 439/231, 239–243, 699.2; 362/217.08, 225
See application file for complete search history.

(56) References Cited

U.S. PATENT DOCUMENTS

| | | | |
|---|---|---|---|
| 2,163,902 | A | 6/1939 | Wertzhelser |
| 2,247,117 | A | 6/1941 | De Reamer |
| 3,176,260 | A | 3/1965 | Pascucci |
| 3,297,977 | A | 1/1967 | Smith |
| 3,305,823 | A | 2/1967 | Dahlhaus |
| 3,328,577 | A | 6/1967 | Pistey et al. |
| 3,384,858 | A | 5/1968 | Johnson |
| 3,397,376 | A | 8/1968 | Gombar |
| 3,401,242 | A | 9/1968 | Mclaughlin |
| 3,524,053 | A | 8/1970 | Johnson |
| 3,568,132 | A | 3/1971 | Johnson |

(Continued)

FOREIGN PATENT DOCUMENTS

DE 32 35 846 A1 4/1983

(Continued)

OTHER PUBLICATIONS

"A Century of Quality Wiring Devices for Original Equipment Manufactures", OEM 100$^{th}$ Anniversary Edition, Leviton Manufacturing Co., Inc. 2005.

(Continued)

*Primary Examiner* — Thanh Tam Le
(74) *Attorney, Agent, or Firm* — Carter, DeLuca, Farrell & Schmidt, LLP

(57) ABSTRACT

A socket assembly includes a rotor, a housing, and first and second conductors. The rotor includes a channel formed therein and defines an axis of rotation. The channel has a length about perpendicular to the axis of rotation and defines first and second ends. The housing receives the rotor such that the rotor is rotatable about its axis of rotation between first and second positions when secured therein. The housing includes a notch. The channel of the rotor aligns with the notch of the housing when in the first position such that first and second lamp pins can be received through the notch of the housing and into the channel of the rotor. The first conductor has first and second ends each disposed on opposite sides of the rotor. The first end of the conductor contacts the first lamp pin when the rotor is in the second position and the second end of the conductor contacts the second lamp pin when the rotor is in the second position. The second conductor is electrically isolated from the first conductor when the rotor is in the first position and is in electrical communication with the first conductor when the rotor is in the second position.

29 Claims, 14 Drawing Sheets

U.S. PATENT DOCUMENTS 3,631,376 A 12/1971 Halfaker
3,639,887 A 2/1972 Johnson et al.
3,651,445 A 3/1972 Francis
3,654,587 A 4/1972 McLaughlin
3,681,593 A 8/1972 Genovese et al.
3,681,594 A 8/1972 Johnson
3,685,003 A 8/1972 Watt
3,752,977 A 8/1973 Davis
3,771,106 A 11/1973 Matsumoto et al.
3,828,299 A 8/1974 Johnson et al.
3,836,814 A 9/1974 Rodriquez
3,851,295 A 11/1974 Geier
3,975,073 A 8/1976 McLaughlin
4,084,873 A 4/1978 Grate
4,101,956 A 7/1978 Crane
4,102,558 A 7/1978 Krachman
4,198,108 A 4/1980 Bassetto
4,198,109 A 4/1980 Ustin
4,280,169 A 7/1981 Allen
4,298,918 A 11/1981 Metcalf, II
4,306,758 A 12/1981 Johnson et al.
4,347,460 A 8/1982 Latassa et al.
4,414,489 A 11/1983 Young
4,495,443 A 1/1985 Cummings
4,542,947 A 9/1985 Flor et al.
4,565,415 A 1/1986 Feinberg
4,570,105 A 2/1986 Engel
4,617,519 A 10/1986 Rosenthal
4,623,823 A 11/1986 Engel
4,637,671 A 1/1987 Johnson et al.
4,643,503 A 2/1987 Johnson et al.
4,645,283 A 2/1987 MacDonald et al.
4,660,906 A 4/1987 Haraden
4,683,402 A 7/1987 Aubrey
4,688,874 A 8/1987 Bjorkman
4,723,200 A 2/1988 Troen
4,744,767 A 5/1988 Henrici et al.
4,746,840 A 5/1988 Lim
4,754,197 A 6/1988 Zwald
D297,322 S 8/1988 Johnson et al.
D297,529 S 9/1988 Johnson et al.
4,772,216 A 9/1988 Szymanek
4,804,343 A 2/1989 Reedy
4,863,394 A 9/1989 Henshaw, Jr.
D304,716 S 11/1989 Johnson et al.
4,936,789 A 6/1990 Ugalde
4,939,420 A 7/1990 Lim
5,006,970 A 4/1991 Mackiewicz
5,015,917 A 5/1991 Nigg
5,044,974 A 9/1991 Pelton et al.
5,122,074 A 6/1992 Maag et al.
5,135,407 A 8/1992 Berends
5,150,008 A 9/1992 Lee
5,169,331 A 12/1992 Caldwell et al.
5,189,339 A 2/1993 Peshak
5,202,607 A 4/1993 Broyer et al.
5,217,190 A 6/1993 Reed et al.
5,261,831 A 11/1993 Vendal et al.
5,282,755 A 2/1994 Ahlstone
5,320,547 A 6/1994 Mews et al.
5,320,548 A 6/1994 Schadhauser
5,390,096 A 2/1995 Dekleine et al.
5,422,487 A 6/1995 Sauska et al.
5,514,000 A 5/1996 Krause et al.
RE35,344 E 10/1996 Fry et al.
5,575,673 A 11/1996 Dahlem et al.
5,596,247 A 1/1997 Martich et al.
5,616,042 A 4/1997 Raby et al.
5,634,820 A 6/1997 Vakil
5,636,919 A 6/1997 Walker
5,653,527 A 8/1997 Muessli
5,688,139 A 11/1997 Gust et al.
5,727,869 A 3/1998 Crosby et al.
5,743,626 A 4/1998 Walker
5,746,615 A 5/1998 Ichikawa et al.
5,758,952 A 6/1998 Getselis et al.
5,759,054 A 6/1998 Spadafore
5,816,837 A 10/1998 Henrici et al.
5,855,487 A 1/1999 Kunishi
D406,814 S 3/1999 Henrici
5,931,691 A 8/1999 Mews et al.
5,971,564 A 10/1999 Wang
D417,653 S 12/1999 Henrici
6,027,230 A 2/2000 Huber et al.
6,039,597 A 3/2000 Getselis et al.
6,048,220 A 4/2000 Eddington et al.
6,082,873 A 7/2000 Schmidt
6,124,673 A 9/2000 Bishop
6,159,029 A 12/2000 Burwell
6,290,522 B1 9/2001 Campolo et al.
6,340,310 B2 1/2002 Henrici et al.
6,364,679 B1 4/2002 Gerstberger
6,486,406 B1 11/2002 Greco et al.
6,561,828 B2 5/2003 Henrici et al.
6,565,230 B2 5/2003 Ashley
6,570,306 B2 5/2003 Henrici et al.
6,582,253 B1 6/2003 Lau
6,632,100 B1 10/2003 Richardson
6,641,419 B1 11/2003 Richardson
D491,890 S 6/2004 Henrici et al.
D493,425 S 7/2004 Henrici et al.
6,869,298 B2 3/2005 Latsis
6,884,103 B1 4/2005 Kovacs
6,890,199 B2 * 5/2005 Vogt et al. ..... 439/238
7,090,390 B2 8/2006 Pazula
7,097,327 B1 8/2006 Barton
7,125,159 B2 10/2006 Hirsch et al.
7,153,151 B2 12/2006 Lingemann et al.
7,247,040 B2 7/2007 Lingemann et al.
D550,884 S 9/2007 Tufano et al.
7,291,029 B2 11/2007 Hale et al.
7,322,722 B2 1/2008 Hartmann et al.
D564,129 S 3/2008 Tufano et al.
7,338,302 B2 3/2008 Thiele et al.
7,339,790 B2 3/2008 Baker et al.
D577,854 S 9/2008 Tufano et al.
7,448,892 B2 11/2008 Dowdle et al.
7,568,930 B2 8/2009 Brand et al.
7,736,163 B2 6/2010 Vogt et al.
2003/0068913 A1 4/2003 Henrici et al.
2003/0100210 A1 5/2003 Lewis
2005/0026483 A1 2/2005 Latsis
2005/0104524 A1 5/2005 Bishop
2005/0148242 A1 7/2005 Latsis
2005/0202704 A1 9/2005 Lingemann et al.
2006/0170323 A1 8/2006 Hirsch et al.
2006/0273730 A1 12/2006 Chang
2007/0066112 A1 3/2007 Tufano et al.
2007/0077801 A1 4/2007 Lingemann et al.
2007/0117466 A1 5/2007 Thiele et al.
2007/0183160 A1 8/2007 Tufano et al.
2009/0130880 A1 5/2009 Vogt et al.
2010/0081339 A1 4/2010 Galluccio et al.
2010/0120279 A1 5/2010 Vogt et al.

FOREIGN PATENT DOCUMENTS

DE 42 08 479 A1 9/1993
DE 20 2006 015 753 U1 1/2007
EP 0 621 661 B1 3/1998
EP 0 834 967 4/1998
EP 1 562 269 A1 8/2005
JP 62-104384 6/1937
JP 61-103887 6/1986

OTHER PUBLICATIONS

Non-Final Office Action for U.S. Appl. No. 12/243,509 dated Mar. 22, 2010.

Non-Final Office Action for U.S. Appl. No. 12/243,509 dated Sep. 27, 2010.

* cited by examiner

LAMP SOCKET HAVING A ROTOR

BACKGROUND

1. Technical Field

The present disclosure relates to lamp sockets, and in particular, to a lamp socket adapted to ensure that a lamp is fully engaged prior to being energized.

2. Description of Related Art

Fluorescent lamps typically comprise a hermetically scaled structure or tube containing one or more eases with a small amount of mercury contained therein. The tube is typically coated with a phosphor-based power along the inside of the tube. Additionally, fluorescent lamps also generally contain two electrodes spaced apart and configured such that current flows through the gas and mercury under certain conditions. When sufficient electric charge is applied between the electrodes, electrons migrate through the gas away from one electrode and towards the other. As aggregate electric charge is displaced, some of the electrons collide with the vapor-phase mercury and excite the electrons contained therein into higher energy states (sometimes incorrectly referred to as "orbital" states). Quickly thereafter, these excited vapor-phase mercury atoms (ionized mercury gas) quickly drop to a lower excitation state and release one or more photons equal to the energy loss resulting from the reduced excitation state of the gas-phase mercury atom. The photons released from the mercury gas are mostly in the ultraviolet region of the light spectrum, and consequentially, are invisible to the human eye and are not typically desirable for human lighting. However, the phosphor-based coatings on the inner surface of the lamp absorbs these UV photons. The absorption of the UV photons excites the phosphor atoms, which alter rising to a higher energy state, quickly return to a lower energy state giving off light mostly in the visible spectrum. These fluorescent lamps typically include at least one pin and commonly two pins electrically connected to an electrode. Each electrode is at the end of the hermetically sealed tube.

In some configurations, current is injected between the two pins of the electrode to heat the electrodes to "boil off" electrons from the metal surface sending them into the gas to partially ionize the gas. However, in some embodiments, this function is bypassed and the two pins are simply electrically connected together in the control circuitry, the lamp socket and/or in the lamp housing. These fluorescent lamps have a life span and therefore need frequent replacing from time to time. Several fluorescent lamp designs have been standardized including their respective lamp sockets; for example, T5, T8 and T12 are standard fluorescent lamp designs and have standardized socket requirements. Lamp sockets are designed so that fluorescent lamps may be quickly installed and/or removed. Typically, the lamp sockets are installed by a technician that inserts the pins of the fluorescent lamp into a socket (usually from the side) and rotates the lamp to secure the lamp within the lamp fixture. These fluorescent lamps are usually electrically connected immediately upon insertion or after a minimal amount of rotation. When a fluorescent lamp is inserted into a lamp socket and not fully rotated, the lamp holder may not be fully seated which may be undesirable.

As such, it would be desirable to configure a lamp socket to ensure that the lamp is fully engaged prior to the lamp being energized. One such configuration is disclosed in commonly owned U.S. patent application Ser. No. 12/243,509, which was tiled on Oct. 1, 2008 to Gregory Gallecio et al., entitled "LAMP SOCKET HAVING A ROTOR ASSEMBLY," the entirety of which is incorporated herein by reference. As provided therein, the lamp socket preferably included a housing, a rotor and a pair of electrical contacts disposed within the housing. The housing preferably included a notch while the rotor preferably included a channel, the notch and channel were adapted and configured to receive the lamp pins extending from the fluorescent lamps.

In use, the rotor was rotatably received within the housing between first and second positions. In the first position, the channel formed in the rotor was aligned with the notch formed in the housing so that the lamp pins could be received through the notch of the housing and into the channel of the rotor. Additionally, the electrical contacts were operatively and electrically disengaged from the lamp pins. Once the lamp pins were inserted into the channel formed in the rotor, the lamp and hence the rotor could be rotated to the second position, which was at a predefined radial angle from the first position (preferably 90 degrees). In the second position, the channel formed in the rotor was not aligned with the notch formed in the housing so that the lamp pins and hence the lamp were secured to the socket assembly. Additionally, the electrical contacts operatively and electrically engaged the lamp pins. In this design, the rotor included a series of protrusions that would radially push the electrical contacts outward, away from the lamp pins until the rotor was in the second position, in which case, the rotor was configured to permit the electrical contacts to protrude into the channel and into engagement with the lamps pins.

It is therefore desirable to provide a design for preventing the electrical contacts from contacting the lamp pins until the lamp is fully secured to the lamp socket.

SUMMARY

In an embodiment of the present disclosure, a socket assembly includes a rotor, a housing, and first and second conductors. The rotor includes a channel formed therein and defines an axis of rotation. The channel has a length about perpendicular to the axis of rotation and defines first and second ends. The housing receives the rotor such that the rotor is rotatable about its axis of rotation between first and second positions when secured therein. The housing includes a notch. The channel of the rotor aligns with the notch of the housing when in the first position such that first and second lamp pins can be received through the notch of the housing and into the channel of the rotor from the first end of the channel. The first conductor has first and second ends each disposed on opposite sides of the rotor. The first end of the first conductor contacts the first lamp pin when the rotor is in the second position, and the second end of the first conductor contacts the second lamp pin when the rotor is in the second position. The second conductor is electrically isolated from the first conductor when the rotor is in the first position and is in electrical communication with the first conductor when the rotor is in the second position.

The first and second ends of the first conductor may define a sharp edge adapted to engage with the first and second lamp pins, respectively, when the rotor is in the second position.

In yet another embodiment of the present disclosure, the socket assembly includes a mounting structure for coupling the housing to a panel. The housing may be attachable to the mounting structure. Alternatively, the housing may be integrally formed with the mounting structure. The mounting structure may be sized and configured to engage the panel by any means now or hereafter known including but not limited to snapping in from above the panel, snapping in from below the panel or slidably engaging the panel. The mounting structure may be adapted to mount through a hole formed in the panel. The mounting structure may have first, second and third snaps adapted to secure the mounting structure to the panel when inserted through the hole. The hole defines a second axis and each of the first, second and third snaps defines an axis about parallel to the second axis. One of the first, second and third snaps (and preferably the second or intermediate snap) is adapted such that the snap is about 180 degrees of rotation about a third axis parallel the second axis relative to the remaining two snaps. The mounting structure may be snap-on attachable to the housing from above the panel.

In yet another embodiment of the present disclosure, the housing includes first and second retaining members. The first retaining member extends from an inside surface of the housing and is adapted to retain the first end of the first conductor. The second retaining member extends from the inside surface of the housing and is adapted to retain the second end of the first conductor. The first and second retaining members preferably each include approximately parallel first and second protrusions to retain the first and second ends, respectively, of the first conductor between the first and second protrusions. The first protrusion may be positioned closer to the axis of rotation of the rotor than the second protrusion. The first and second protrusions each define a length, and the length of the first protrusion may be less than the length of the second protrusion.

In another embodiment of the present disclosure, the second conductor preferably includes a spring-like portion or member adapted to electrically contact the first conductor when the rotor is in the second position. The second conductor preferably abuts the mounting structure within an inner space of the housing. The second conductor preferably includes a projection or rounded dimple adapted for insertion into a complimentary space formed in the mounting structure. The first conductor preferably includes a projection or rounded dimple adjacent to the second conductor. The second conductor preferably includes a spring, e.g., an elongated metallic member having a free end. The elongated spring-like member including a projection or curved dimple adjacent to the first conductor. The free end is preferably in sliding engagement with another elongated member of the second conductor. The rotor preferably includes a flange along at least one radial partition of the rotor adapted to abut the free end of the second conductor. The flange preferably includes an opening such that the free end of the second conductor contacts the first conductor through the opening when the rotor is in the second position.

In yet another embodiment of the present disclosure, the second conductor preferably includes a spring-like portion and the rotor includes a flange along at least one radial partition of the rotor adapted to abut the spring-like portion of the second conductor. The flange preferably defines an opening such that the spring-like portion of the second conductor contacts the first conductor through the opening when the rotor is in the second position.

In another embodiment of the present disclosure, the rotor preferably includes at least one radial protrusion adapted to engage the first conductor so that the first conductor contacts the second conductor when the rotor is in the second position.

In yet another embodiment of the present disclosure, the rotor preferably includes a flange along at least one radial partition of the rotor. The flange is adapted to abut the second conductor so that the second conductor is displaced from the first conductor and thus electrically isolated from the first conductor when the rotor is in the first position. The flange preferably defines an opening such that the second conductor contacts the first conductor through the opening when the rotor is in the second position and thus electrically communicating the first and second conductors.

In an embodiment of the present disclosure, the rotor preferably includes a hole extending therethrough. The hole preferably includes a center about centered along the axis of rotation of the rotor when secured within the housing. The inner surface of the housing preferably includes a cam extending through the hole of the rotor, the cam being adapted to engage the rotor such that the rotor is rotatable about the axis of rotation of the rotor when secured within the housing. The cam may include first and second retaining members adapted to secure the rotor within the housing. The rotor preferably includes a flange extending inwardly towards the center of the hole. The first and second retaining members extend outwards from the cam in opposite directions and the first and second retaining members are in sliding engagement with the flange thereby securing the rotor within the housing.

BRIEF DESCRIPTION OF THE DRAWINGS

These and other advantages will become more apparent from the following detailed description of the various embodiments of the present disclosure with reference to the drawings wherein.

DETAILED DESCRIPTION

In the Summary section above, in this detailed description, in the claims below, and in the accompanying drawings, reference is made to particular features of the present disclosure. It is to he understood that the disclosure in this specification includes combinations of parts, features, or aspects disclosed herein. For example, where a particular feature is disclosed in the context of a particular aspect or embodiment of the present disclosure, or a particular claim, that feature can also be used, to the extent possible, in combination with and/or in the context of other particular aspects and embodiments of the present disclosure, and in the disclosure generally.

Figure 1A:
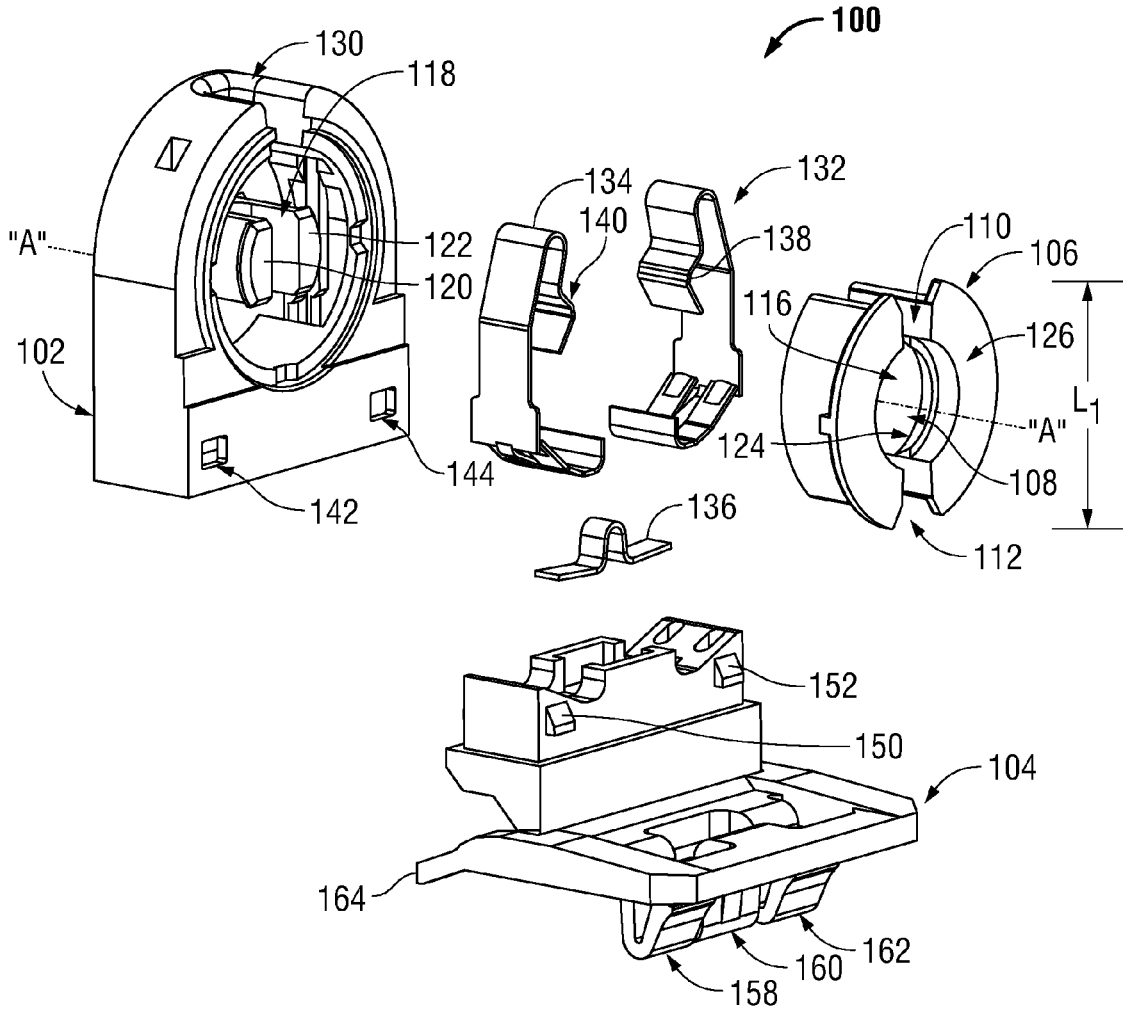
FIG. 1A shows an exploded, perspective view of a socket assembly in accordance with an embodiment the present disclosure.
Figure 1B:
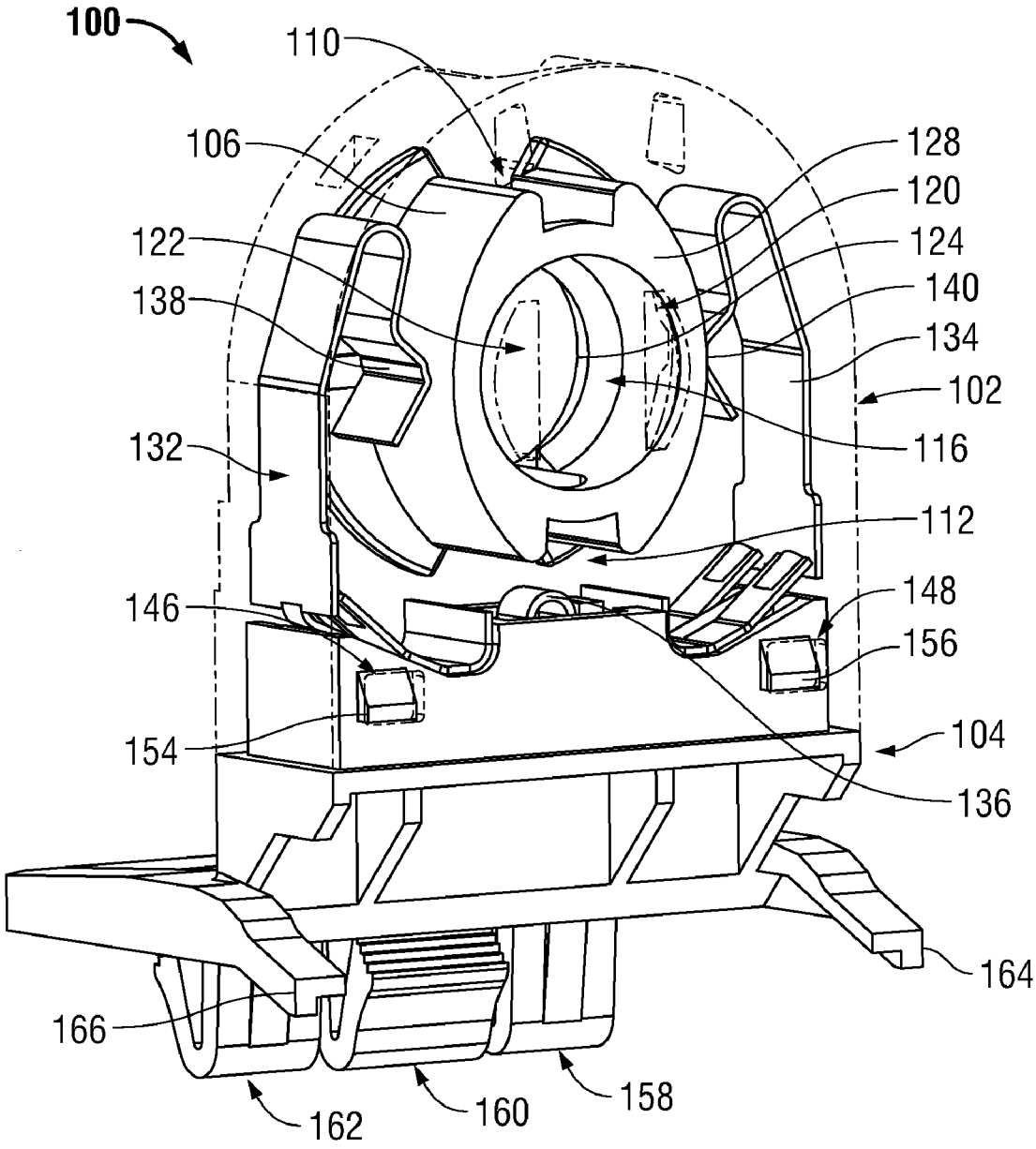
FIG. 1B shows a partial, perspective view of the socket assembly illustrated in FIG. 1A.

Referring to the drawings, FIGS. 1A-1B show a socket assembly 100 having a housing 102 (illustrated with dotted lines in FIG. 1B) attachable to a mounting structure 104 in accordance with an embodiment of the present disclosure. A rotor 106 is secured within the housing 102 and defines a channel 108. The channel 108 defines a first end 110 and a second end 112. The channel 108 is a length "L1." The rotor 106 is rotatably coupled to the housing 102 between first and second positions. The first end 110 of the channel 108 aligns with a notch 130 formed in the housing 102 when the rotor 106 is in the first position, as shown in FIG. 1B.

The rotor 106 defines a hole 116. A cam 118 extends from an inner surface of the housing 102. The cam 118 includes retaining members 120, 122. The retaining members 120, 122 are sized and configured to secure the rotor 106 within the housing 102. As best shown in FIG. 1B, the rotor 106 also includes a flange 124. The flange 124 compliments the retaining members 120, 122 such that the rotor 106 is rotatable within the housing 102; and the retaining members 120, 122 are in sliding engagement with the flange 124 of the rotor 106.

The rotor 106 includes a receiving side 126 and a back side 128. The channel 108 formed in the rotor 106 is sized and configured to receive two-lamp pins (not shown), which extend from a lamp, such as, for example, a fluorescent lamp (not shown), via the notch 130 formed in the housing 102 when the rotor 106 is in the first position. The lamp pins are received when about parallel to axis "A." Once the lamp pins are within the channel 108, the lamp may be rotated thereby also rotating the lamp pins and rotor 106 around axis "A". The rotational forces of the lamp cause the rotor 106 to rotate along the axis "A."

Initially, when the rotor 106 is in the first position as shown in FIG. 1B, the channel 108 is aligned with the notch 130 to receive the lamp pins. After the two-lamp pins are received but while the rotor 106 remains in the first position as shown in FIG. 1B, conductors 132, 134 therein (see FIG. 1B) are not in electrical communication with the lamp pins. That is, the conductors 132, 134, which will be described in greater detail below, do not contact the lamp pins. However, the rotor 106 is rotatable from the first position shown in FIGS. 1A-1B to other positions, e.g., a second position approximately 90 degree of rotation around the axis "A" from the first position as shown in FIGS. 1A-1B.

More specifically, as best seen in FIG. 1B, the socket assembly includes conductors 132, 134, and a shunt 136. Conductor 132 includes a protrusion 138 and conductor 134 includes a protrusion 140. Also, as the lamp pins (not shown) are rotated in a counterclockwise manner (from the perspective of FIG. 1B), the rotor 106 also rotates such that the first end 110 of the channel 108 aligns with the protrusion 138, and the second end 112 of the channel 108 aligns with the protrusion 140. Additionally or alternatively, the lamp pins along with the rotor 106 are rotatable in a clockwise manner. In use, conductors 132, 134 are in compression against the rotor 106. When the first end 110 is aligned with the conductor 132, the compression of the conductor 132 causes the protrusion 138 to enter into the channel 108 and contact a lamp pin (not shown) positioned therein. Likewise, when the second end 112 is aligned with the conductor 134, the compression of the conductor 134 cause the protrusion 140 to enter into the channel 108 via the second end 112 and contact a lamp pin (not shown) therein. The shunt 136 electrically couples the conductors 132, 134 to a ballast. Because conductors 132, 134 are electrically coupled to the lamp pins, the lamps pins are electrically coupled to the ballast (not shown).

As previously described, when the rotor is rotated 90 degrees about axis "A," the lamp pins positioned therein make electrical contact with the conductors 132, 134 only when substantially rotated to the second position. This prevents the lamp from being energized until the rotor 106 is rotated because the two lamp pins are not in electrical communication with the conductors 132, 134 until the rotor 106 is rotated to a second predetermined position, which in this embodiment as mentioned above, is 90 degrees of rotation around axis "A."

Additionally, because the conductors 132, 134 protrude into the channel 108 and apply a compressive force against the rotor 106, the rotor 106 snaps into a semi-locked position while simultaneously and suddenly making full electrical contact with the lamp pins with the conductors 132, 134. The conductors 132, 134 are wired for operation of the lamp, e.g., a fluorescent lamp may be wired to an electrical ballast via the internal conductors. Various embodiment of the socket assembly 100 may be adapted to receive several types of lamp sockets, including, a T5 lamp, a T8 lamp and a T12 lamp. Additionally, the socket assembly 100 may have torque resistance from further rotation about axis "A" after positioned in the semi-locked position.

As previously mentioned, the housing 102 may be adapted to be attachable to a mounting structure 104. The socket assembly 100 is preferably attachable to the mounting structure 104 such that axis "A" is parallel to a panel (as mounted thereto) and is preferably a distance therefrom, e.g., 16 millimeters, 20 millimeters or 23 millimeters. The distance may be any amount, for example the first distance may be greater than 12 millimeters, e.g., from about 16 millimeters to about 30 millimeters.

The housing 102 may be attached to the mounting structure 104 by any means now or hereafter known. Alternatively, the housing 102 may be integrally formed with the mounting structure 104. The housing 102 may include holes 142, 144, 146, 148 positioned and shaped to compliment snaps 150, 152, 154, 156, respectively. The mounting structure 104 attaches the housing 102 with the rotor 106 to a panel (not shown). For example, two socket assemblies 100, each lacing each other may be attached to a lighting panel. A fluorescent bulb (not shown) may be positioned between the two socket assemblies 100 and thereafter may be rotated to enable electrical communication with the fluorescent bulb.

The mounting structure 104, and hence the socket assembly 100, is attachable to a panel by any means now or hereafter known. For example, the mounting structure may be sized and configured to slidably engage the panel (as generally illustrated by the mounting structure in FIGS. 3A and 4A-4E), the mounting structure may be designed to be snapped onto the panel from below (not shown), the mounting structure may be sized and configured to be snapped onto the panel from above, etc. In one preferred embodiment, as illustrated by the mounting structure in FIGS. 1A-2 and as described in greater detail in U.S. patent application Ser. No. 12/243,509, the panel preferably includes a single hole (not shown) while the mounting structure 104 includes first, second and third snaps 158, 160, 162. The first, second and third snaps 158, 160, 162 being sized and configured to snap into the sufficiently sized hole formed in the panel from above. Each of snaps 158, 160, and 162 can snap into multiple panel thicknesses. The socket assembly 100 also may include springs 164 and 166 so that the mounting structure 104 can apply a compressive force against the mounting panel having the hole (not shown) when the snaps 158, 160, and 162 are inserted therein.

Figure 2:
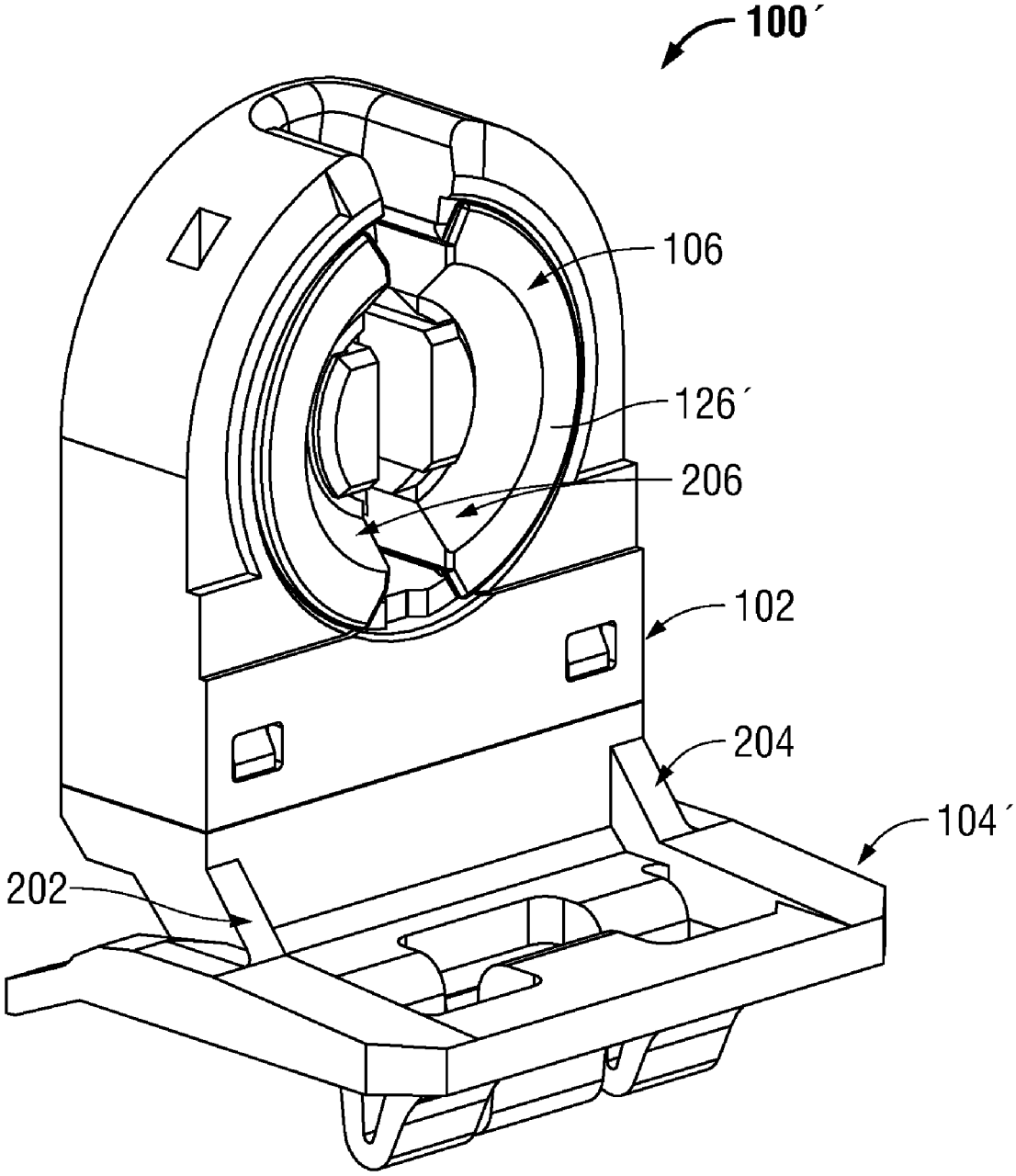
FIG. 2 shows a perspective view of a socket assembly in accordance with another embodiment of the present disclosure.

Referring to the drawings, FIG. 2 shows a socket assembly 100' having a housing 102 adapted to be attachable to a mounting structure 104' in accordance with another embodiment of the present disclosure. The socket assembly 100' of FIG. 2 is similar to the socket assembly 100 of FIGS. 1A-1B. The socket assembly 100' of FIG. 2 has a mounting structure 104' having support members 202 and 204. The support members 202 and 204 provide additional support to counter force applied to the housing 102 when mounted in a lamp panel (not shown). Also, the socket assembly 100' includes a rotor 106'. The rotor 106' has a concaved shaped region 206 on the receiving side 126' of the rotor 106'.

Figure 3A:
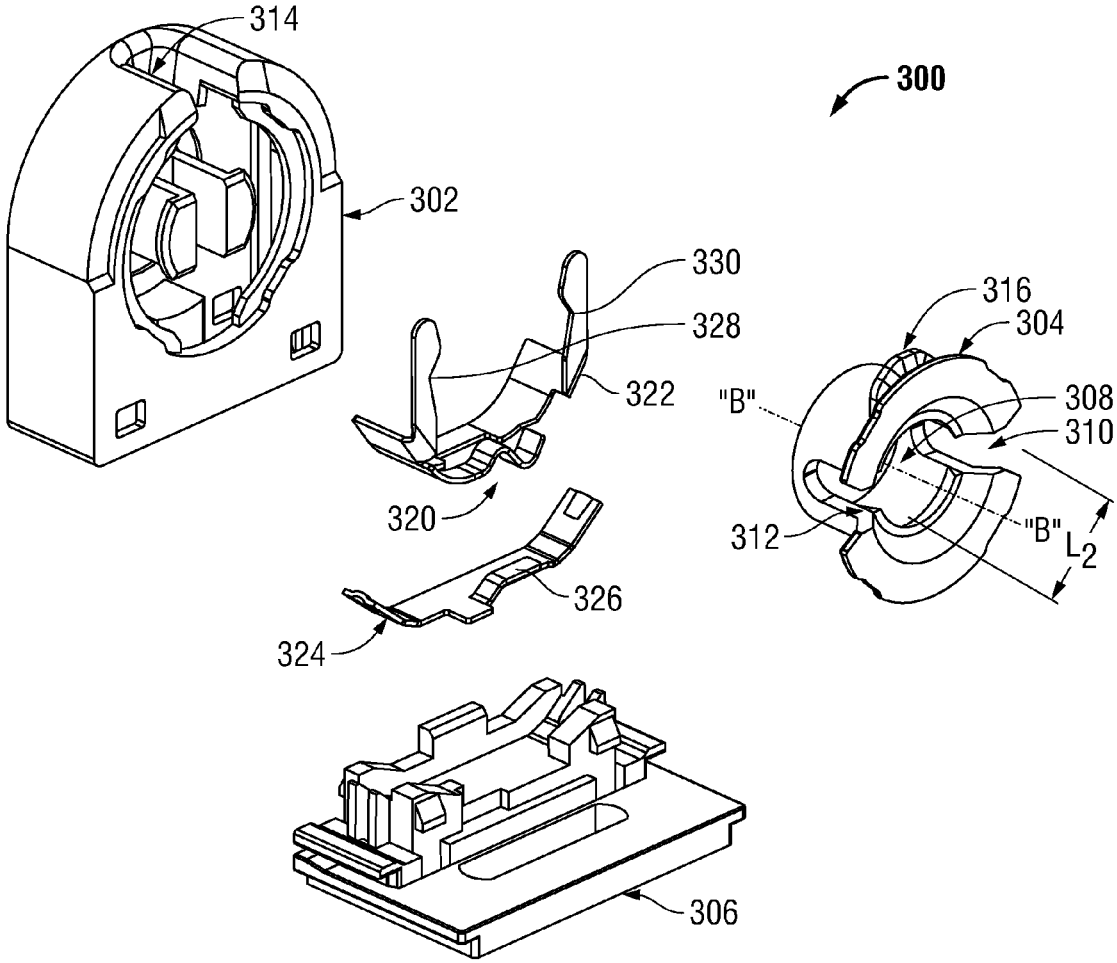
FIG. 3A shows an exploded, perspective-view of a socket assembly in accordance with yet another embodiment of the present disclosure.
Figure 3B:
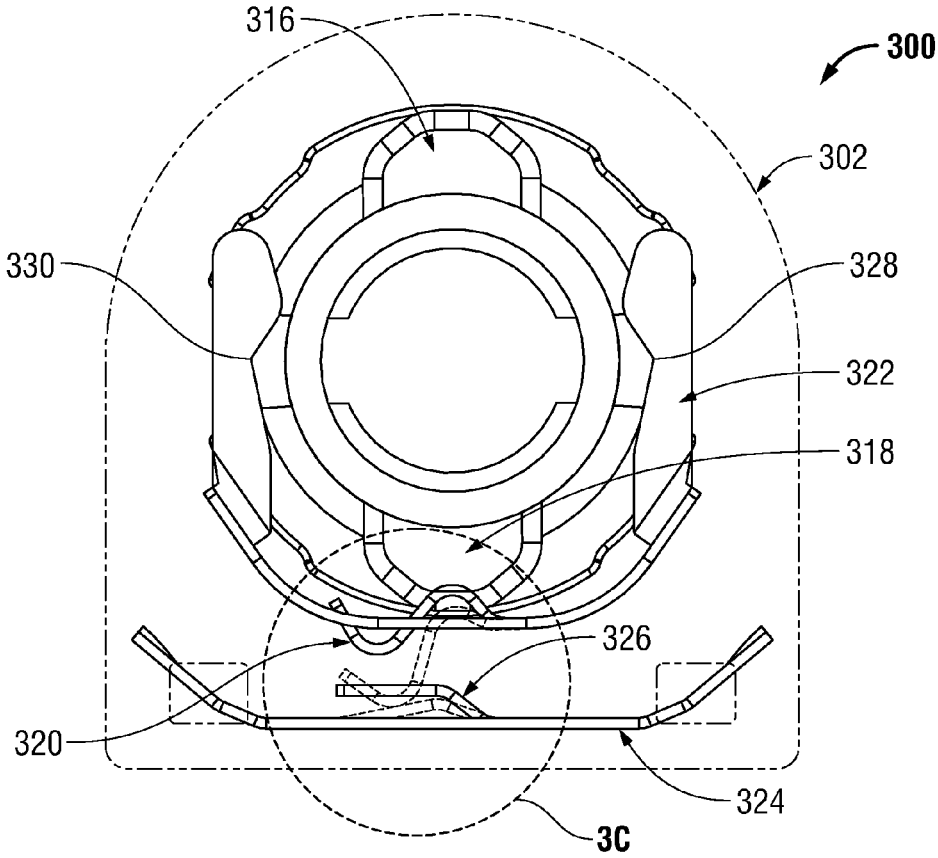
FIG. 3B shows a partial, back-view of the socket assembly illustrated in FIG. 3A.

FIG. 3A shows an exploded perspective-view of a socket assembly 300 in accordance with yet another embodiment of the present disclosure; and FIG. 3B shows a back-view of the socket assembly 300 in accordance with the embodiment shown in FIG. 3A. Socket assembly 300 includes a housing 302, a rotor 304, a mounting structure 306 (which may or may not be integrally formed with the housing 302 and/or which may be any mounting structure now or hereafter known as previously described), and first and second conductors 322, 324. The rotor 304 is rotatable within the housing 302 along an axis "B" and has a channel 308 having a length "L2."

Figure 3C:
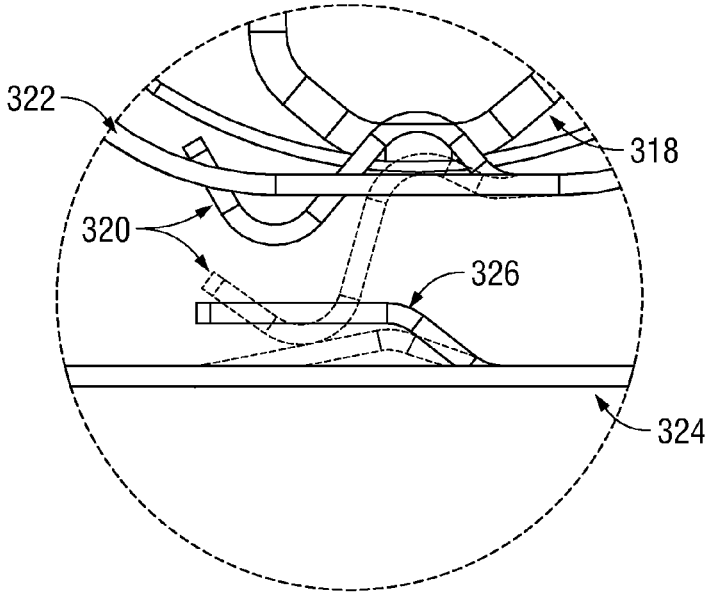
FIG. 3C shows a close-up, back-view of an exemplary spring used in connection with the socket assembly illustrated in FIG. 3A.

The channel 308 defines ends 310 and 312. The end 312 aligns with a notch 314 formed in the housing 302. After insertion of lamp pins (not shown) through the notch 314 and into the channel 308, a torque applied to the lamp causes the rotor 304 to rotate. Referring to 313, the rotor 304 preferably includes radial protrusions 316, 318. As the rotor 304 rotates, the radial protrusions 316, 318 rotate with the rotor 304. Rotation of the rotor 304 causes one of the protrusions 316, 318 (shown as protrusion 318) to contact a spring-like portion or member, more preferably an S-shaped spring 320, formed on the first conductor 322 as shown in FIG. 3C, which in turn causes the first conductor 322 to contact the second conductor 324. As such, the second conductor 324 is in electrical communication with the first conductor 322 when the spring-like portion or member, more preferably the S-shaped spring 320, of the first conductor 322 is in contact with the second conductor 324. The second conductor 324 preferably includes an elongated member 326. The elongated member 326 preferably extends toward the first conductor 322 to facilitate contact between the second conductor 324 and the first conductor 322. The second conductor 324 is preferably electrically connected to a ballast (not shown) to provide power to lamp pins (not shown), when the lamp pins are inserted into the rotor 304 and the first and second conductors 322, 324 are in electrical communication. Other conductor configurations are contemplated such that the first conductor 322 and the second conductor 324 are electrically isolated from each other when the rotor 304 is in the first position (e.g., are not contacting each other) and are in electrical communication with each other when the rotor 304 is in the second position (e.g., are contacting each other).

Referring again to FIGS. 3A-3B, the first conductor 322 may include a pair of sharp edges 328, 330 for compressing against the rotor 304 and contacting the lamp pins (not shown) when rotated to the engaged, second position (i.e., when the lamp is fully rotated for operation).

FIGS. 4A-4F show various views of a socket assembly 400 in accordance with yet another embodiment of the present disclosure. The socket assembly 400 includes a rotor 402 rotatable along axis "C" within a housing 404. The rotor 402 defines a channel 406 having a first end 408 and a second end 410, and a length "L3." As previously described, the housing 404 may be coupled to a mounting structure 412, which may he any mounting structure now or hereafter known as previously described. The housing may include holes 414, 416, 418, 420, which are shaped to cooperate with snaps 422, 424, 426, 428 formed on the mounting structure 412. Alternatively, the housing 404 and mounting structure 412 may be integrally formed.

The first end 408 of the channel 406 aligns with a notch 430 formed in the housing 404 when the rotor is in a first position. Lamp pins are received within the notch 430. Thereafter, the lamp (not shown) may be rotated thereby rotating the rotor 402 along the axis "C."

Figure 4A:
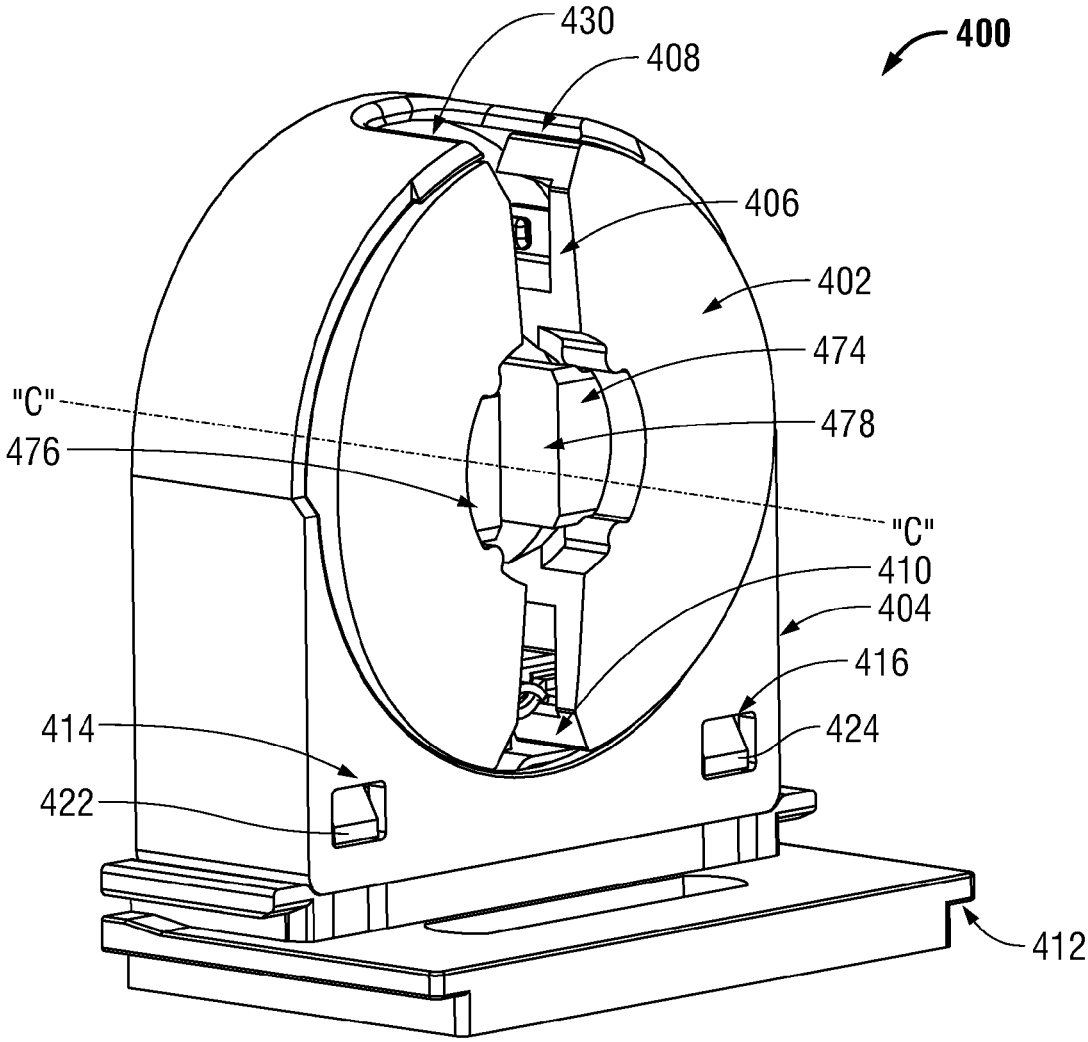
FIG. 4A shows a perspective view of a socket assembly in accordance with yet another, embodiment of the present disclosure.
Figure 4B:
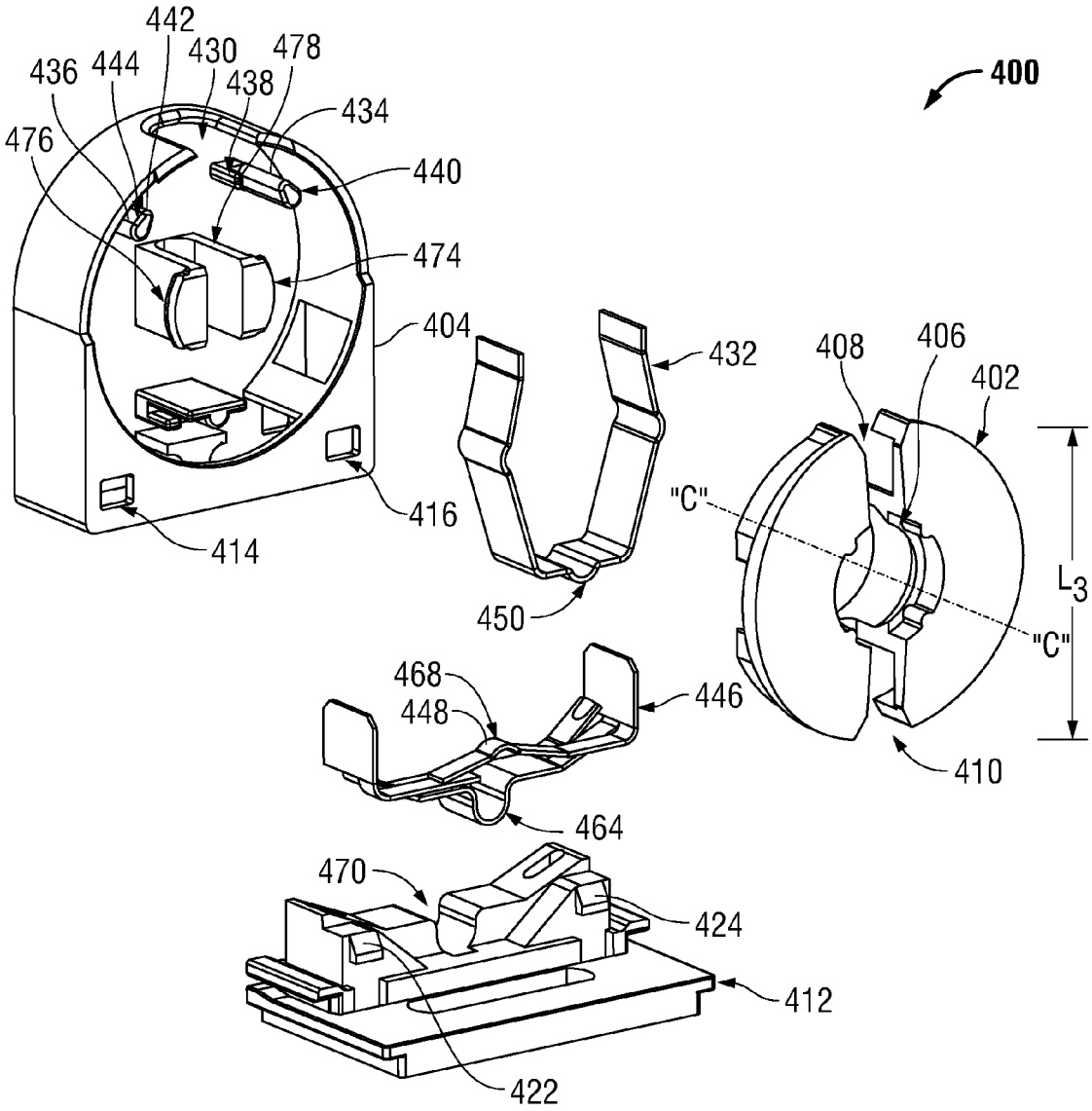
FIG. 4B shows an exploded, perspective-view of the socket assembly illustrated in FIG. 4A.
Figure 4C:
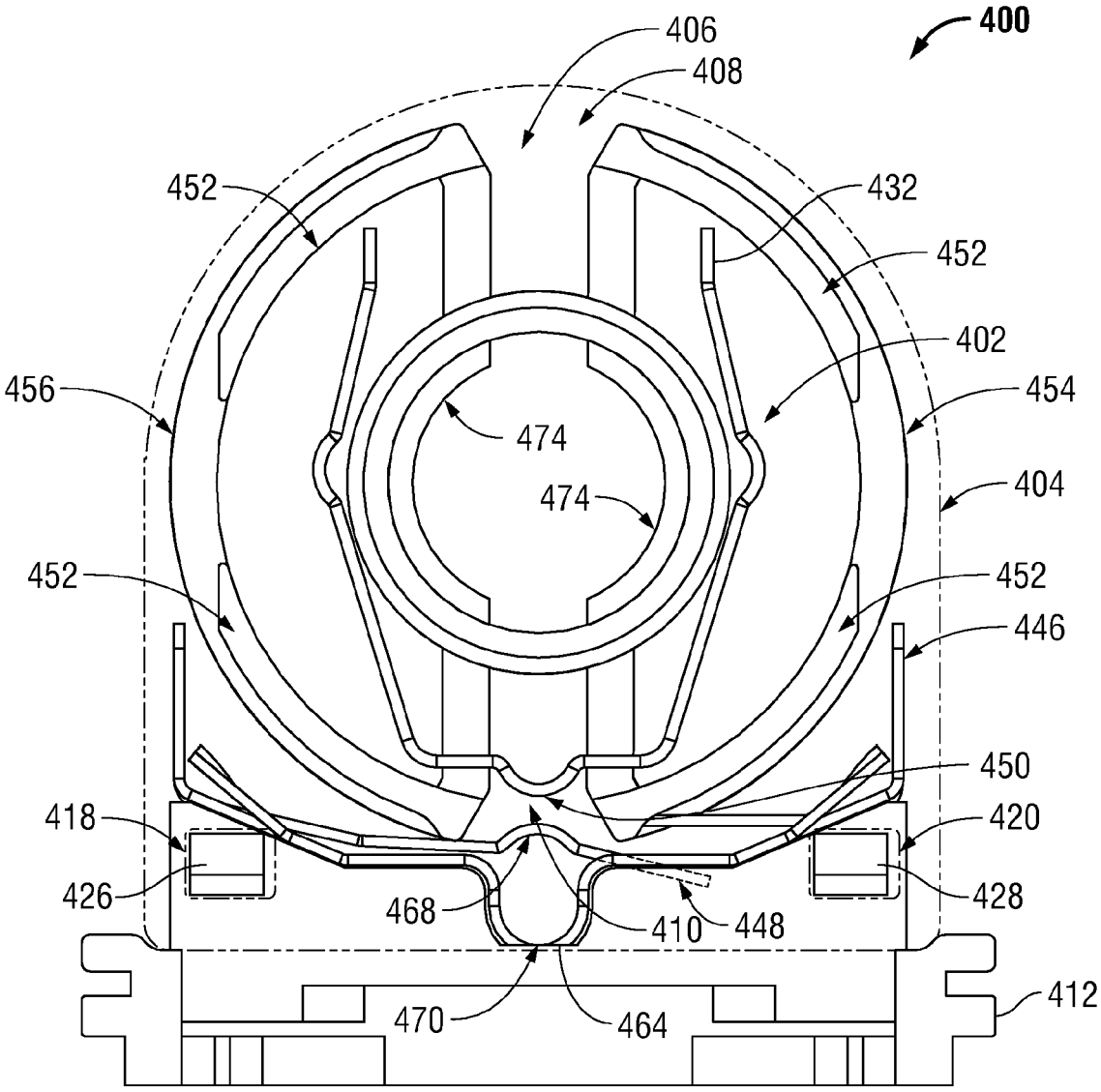
FIG. 4C-4E show various partial illustrations of an exemplary rotor rotating within an exemplary housing of the socket assembly illustrated in FIG. 4A.
Figure 4D:
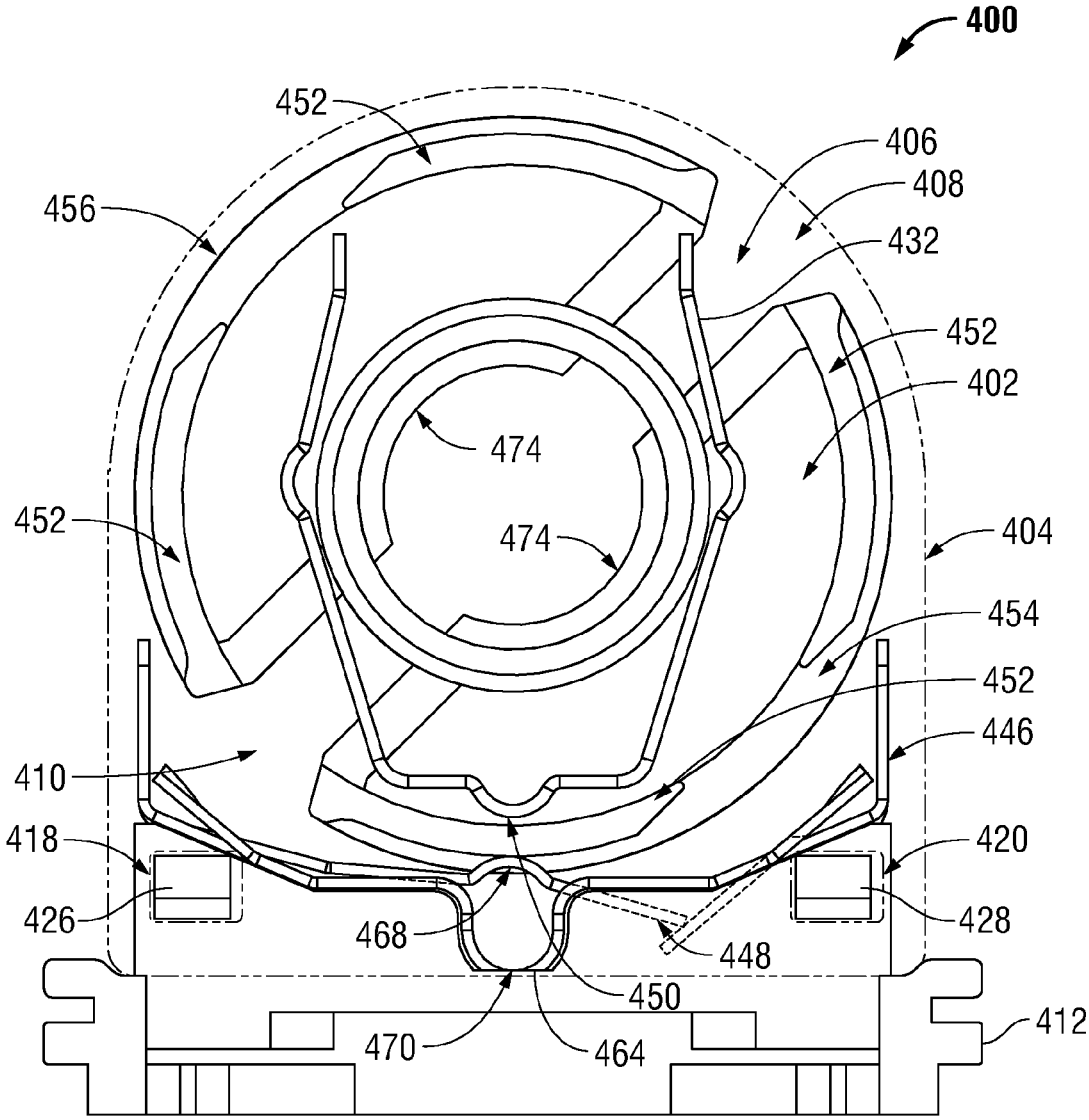
Figure 4E:
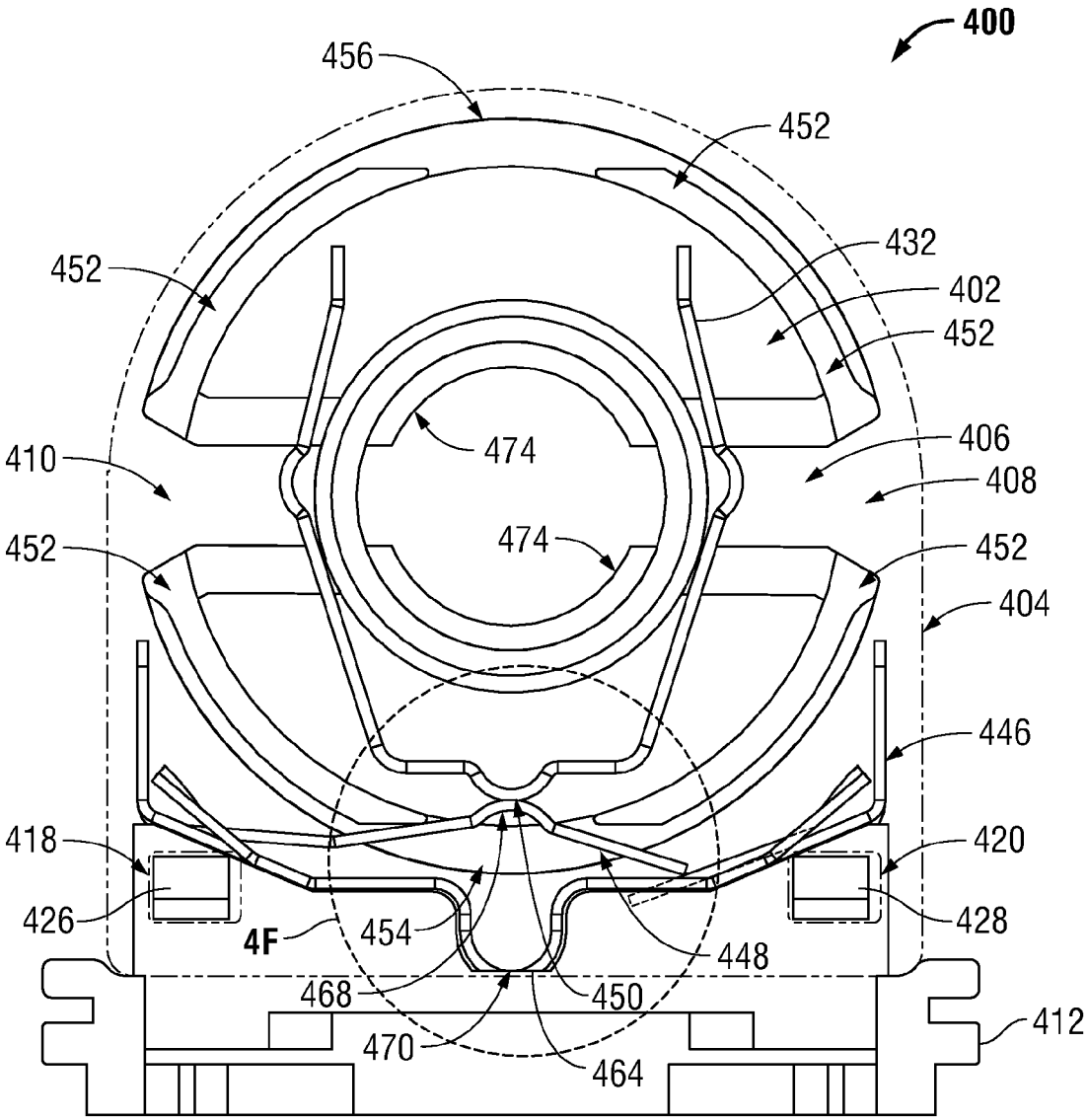

Referring now to the drawings, FIGS. 4C-E showing a hack-view of the socket assembly 400. The housing 404 is shown as transparent. Within the housing 404 are a first conductor 432 and a second conductor 446. The housing 404 preferably includes a first retaining member 434 and a second retaining member 436 (shown in FIG. 4B) to secure the first conductor 432 within the housing 404. The first retaining member 434 preferably includes a first protrusion 438 and a second protrusion 440 (shown in FIG. 4B). The first protrusion 438 may be longer than the second protrusion 440. Similarly, the second retaining member 436 includes a third protrusion 442 and a fourth protrusion 444. The retaining members 434, 436 hold the first conductor 432 within the housing 404.

Figure 4F:
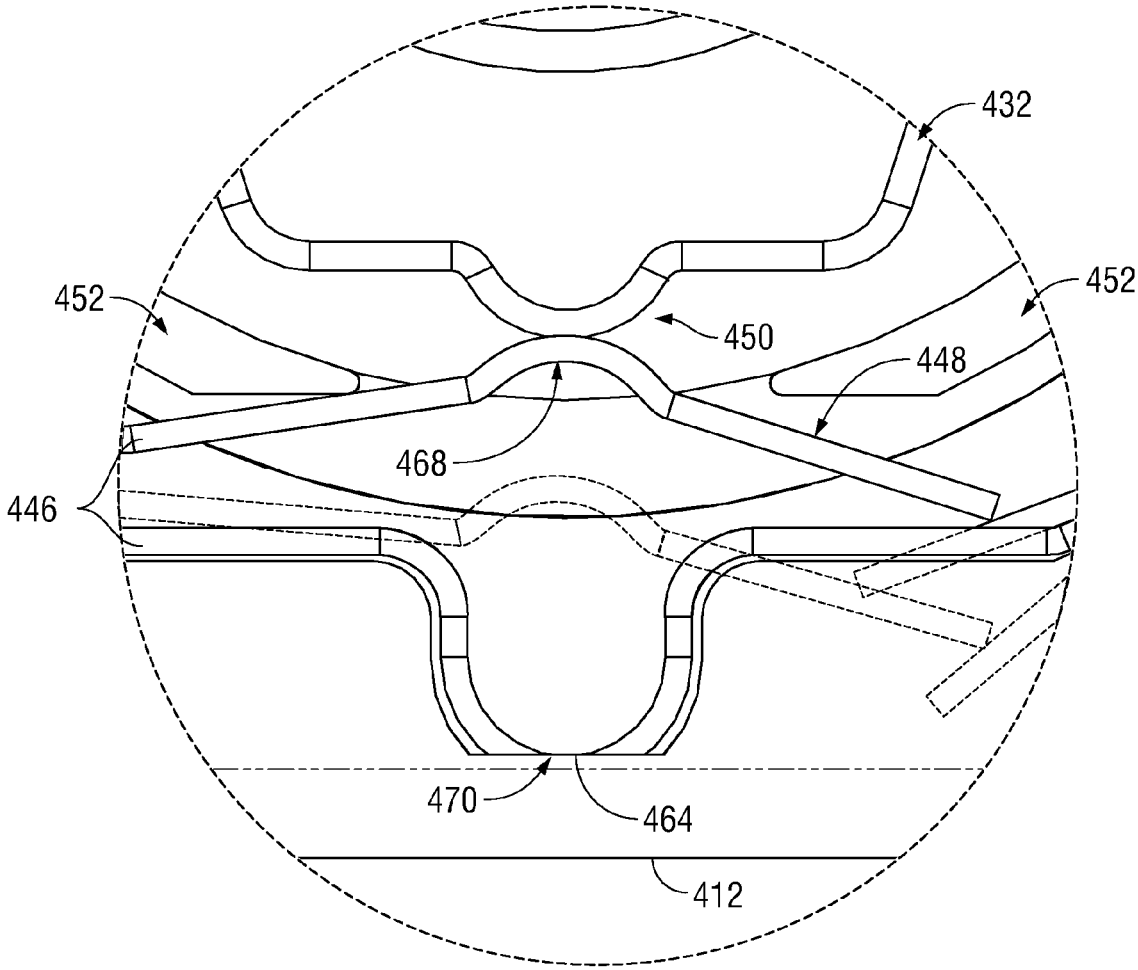
FIG. 4F shows a partial close-up, back-view of the socket assembly illustrated in FIG. 4A.

Also within the housing is a second conductor 446. The second conductor 446 preferably includes a spring-like portion or member 448. The spring 448 is preferably sized and configured to move between a first position and a second position so that the second conductor 446 can move out of and into contact with the first conductor 432, as will be described in greater detail below. More preferably, as shown, the first conductor 432 may include a projection or rounded dimple 450 for contacting the spring 448. The rotor 402 includes a flange 452 defining openings 454 and 456. As is best seen in FIGS. 4C-4E, a rotation sequence-of-events of the rotor 402 are shown. FIG. 4C shows the rotor 402 in the first position. Of importance to note is that the channel 406 formed in the rotor 402 is aligned with the notch 430 formed in the housing 404 so that the lamp pins can be received within the channel 406. In addition, the flange 452 formed on the rotor 402 contacts the second conductor 446 so that the second conductor 446 is not in electrical communication with the first conductor 432 (i.e., the second conductor 446 does not contact the first conductor 432). FIG. 4D shows the rotor 402 rotated 45 degrees. FIG. 4E shows the rotor 402 rotated 90 degrees to a predetermined second position. Of importance to note is that the channel 406 formed in the rotor 402 is no longer aligned with the notch 430 formed in the housing 404 so that the lamp pins that were previously inserted into the channel 406 when the rotor 402 was in the first position are now safely secured therein. In addition, the second conductor 446 is now aligned with one of the openings 454, 456 formed in between the flanges 452 of the rotor 402 so that the second conductor 446 is in electrical communication with the first, conductor 432 (i.e., the second conductor 446 contacts the first conductor 432). FIG. 4F shows a close-up view of the spring 448 contacting the rounded dimple 450 of the first conductor 432 via the rounded dimple 468 of the second conductor 446.

More specifically, in use, the flange 452 formed on the rotor 402 presses against the second conductor 446, more preferably the spring 448, unless one of the openings 454, 456 located between the flanges 452 are aligned over the spring 448. When one of the openings 454, 456 is aligned over the spring 448, the spring 448 enters into the opening and contacts the first conductor 432. More preferably, as shown in FIGS. 4E-4F, the spring 448 enters into the opening 456 and contacts the rounded dimple 450 of the first conductor 432.

Figure 4G:
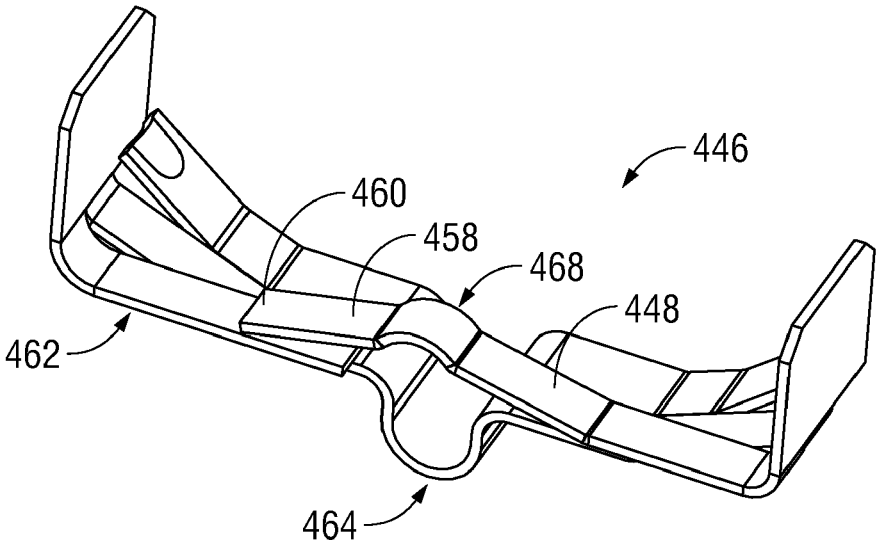
FIG. 4G shows a perspective view of an exemplary conductor disposed within the housing of the socket assembly illustrated in FIG. 4A.
Figure 4H:
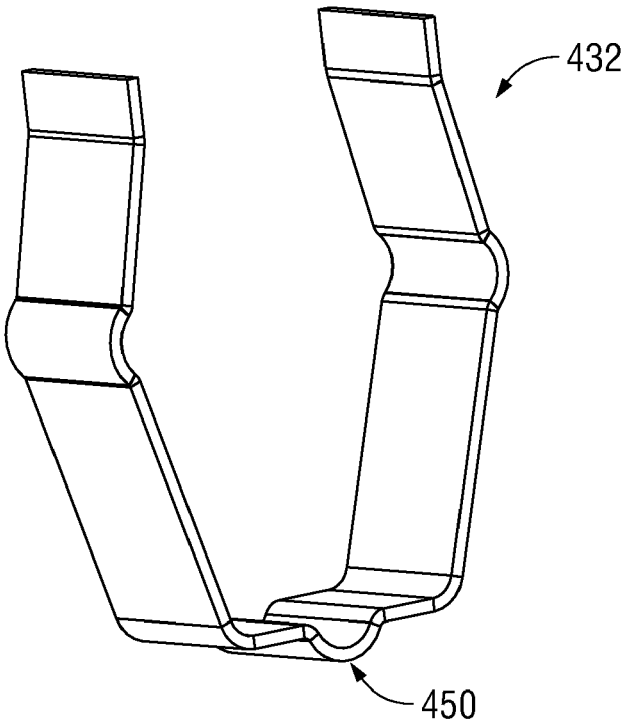
FIG. 4H shows a perspective view of an exemplary conductor disposed within the housing of the socket assembly illustrated in FIG. 4A.
Figure 4I:
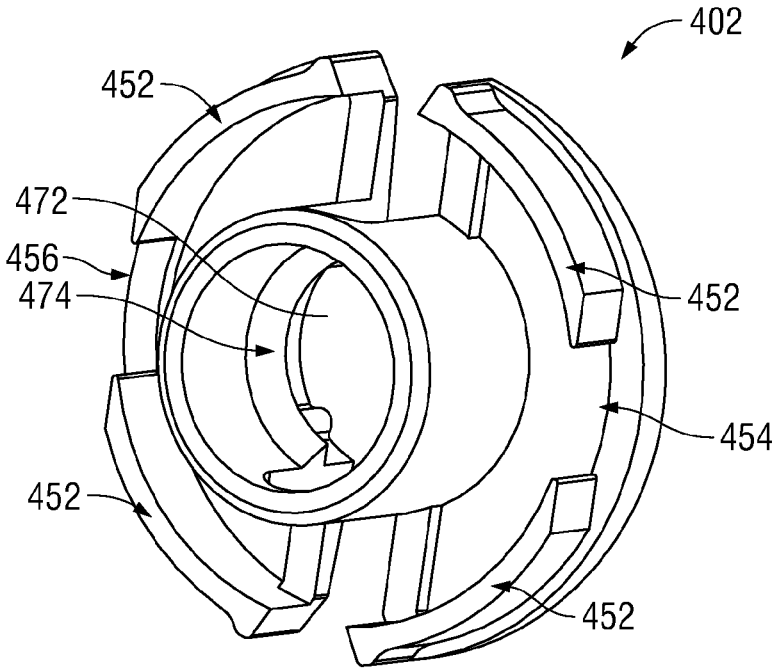
FIGS. 4I-4L, show various views of the rotor of the socket assembly illustrated in FIG. 4A.
Figure 4J:
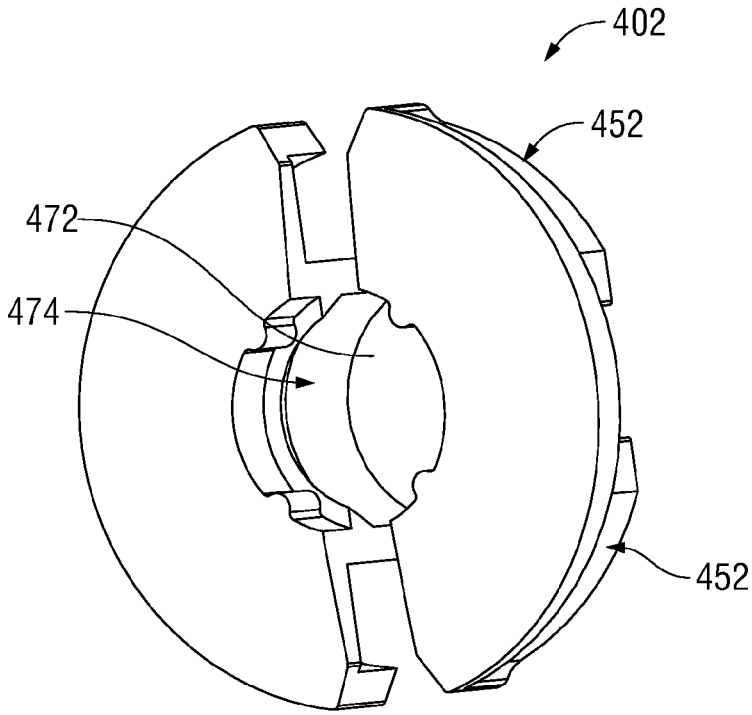
Figure 4K:
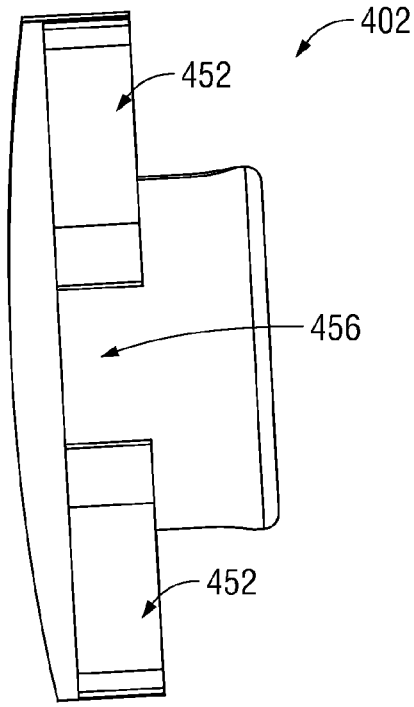
Figure 4L:
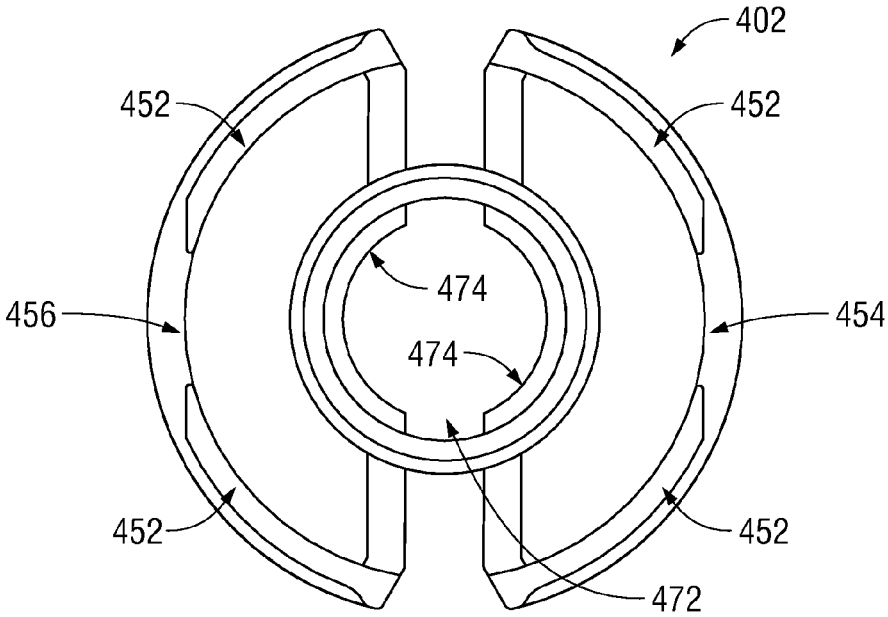

Referring to the drawings, FIG. 4G shows a perspective view of the second conductor 446 of the socket assembly 400. The second conductor 446 includes an elongated first metallic member 458 that has a free end 460. The free end 460 is in sliding engagement with a second elongated metallic member 462. The second conductor 446 also preferably includes a projection or rounded dimple 464. The spring 448 also preferably includes a projection or rounded dimple 468 for contacting the first conductor 432 (see FIG. 4C). Referring to FIGS. 4C-4G, the mounting structure 412 defines a complementary space 470 in which the projection or rounded dimple 464 of the second conductor 446 is secured within. The projection or rounded dimple 464 keeps the second conductor 446 positioned properly within the housing 404. FIG. 4H shows a perspective view of the first conductor 432 of the socket assembly 400. The projection or rounded dimple 450 of the first conductor 432 contacts the projection or rounded dimple 464 of the second conductor 446 when the spring 448 is not in compression. However, note that the first and second conductors, 432, 446 are not limited to the precise configuration shown in FIGS. 4A-4H; for example, other configures not depicted such that the first and second conductors 432, 446 can move into and out of contact with each other as the rotor 402 is rotated between first and second positions are contemplated.

Referring now to FIGS. 4I-4L various views of the rotor 402 are shown. The rotor 402 includes one or more flanges 452 and openings 454 and 456, located between the flanges 452. The flanges 452 prevents the second conductor.446, and more preferably the spring 448, from contacting the first conductor 432. The second conductor 446 may be connected to a ballast (not shown).

The rotor 402 also preferably includes a hole 472. The rotor 402 defines a flange 474 that extends inwardly toward the center of the hole 472. The flange 474 facilitates the retaining members 474 and 476 of cam 478 (See FIG. 4A) to retain the rotor 402 within the housing 404. The retaining members 474 and 476 may be in sliding engagement with the flange 474.

Although the invention has been described with reference to preferred embodiments, it is understood that the words which have been used herein are words of description and illustration, rather than words of limitation. For instance, it should be appreciated that the structures and features of the various socket assemblies described herein and their components can be incorporated into any of the other socket assemblies described herein and their components, unless otherwise indicated. Furthermore, although the invention has been described herein with reference to particular structures, methods, and embodiments, the invention is not intended to be limited to the particulars disclosed herein, as the invention extends to all structures, methods and uses that are within the scope of the present invention. Those skilled in the relevant art, having the benefit of the teachings of this specification, may effect numerous modifications to the invention as described herein, and changes may be made without departing from the scope and spirit of the invention, for instance as recited in the appended claims.

The term "comprises" and grammatical equivalents thereof are used herein to mean that other components, ingredients, steps, acts, etc. are optionally present. For example, an article "comprising" (or "which comprises") components A, B, and C can consist of (i.e., contain only) components A, B, and C, or can contain not only components, A, B, and C but also one or more additional components, elements, or features.

The term "at least" followed by a number is used herein to denote the start of a range beginning with that number (which may be a range having an upper limit or no upper limit, depending on the variable being defined). For example, "at least one" means one or more than one. The term "at most" followed by a number is used herein to denote the end of a range ending with that number (which may be a range having 1 or 0 as its lower limit, or a range having no lower limit, depending upon the variable being defined). For example, "at most 40%" means 40% or less than 40%. When, in this specification, a range is given as "(a first number) to (a second number)" or "(a first number) (a second number)," this means a range whose lower limit is the first number and whose upper limit is the second number. For example, 25 to 100 mm means a range whose lower limit is 25 mm, and whose upper limit is 100 mm.

Any element in a claim that does not explicitly state "means for" performing specified function or "step for" performing a specified function, is not to be interpreted as a "means" or "step" clause as specified in 35 U.S.C. §112, ¶6. In particular, the use of "step of" in the claims is not intended to invoke the provisions of 35 U.S.C. §112, ¶6.

What is claimed is:

1. A socket assembly, comprising:

a rotor including a channel formed therein and defining an axis of rotation, the channel having a length about perpendicular to the axis of rotation, the channel defining first and second ends;

a housing adapted to receive the rotor such that the rotor is rotatable about its axis of rotation when secured therein, the rotor is rotatable with respect to the housing between first and second positions, the housing including a notch, the channel of the rotor aligns with the notch of the housing when in the first position such that first and second lamp pins can be received through the notch of the housing and into the channel of the rotor from the first end of the channel;

a first conductor having first and second ends each disposed on opposite sides of the rotor, wherein the first end of the conductor contacts the first lamp pin when the rotor is in the second position and the second end of the conductor contacts the second lamp pin when the rotor is in the second position; and a second conductor electrically isolated from the first conductor when the rotor is in the first position and is in electrical communication with the first conductor when the rotor is in the second position.

2. The socket assembly according to claim 1, wherein the first and second ends of the first conductor each define a sharp edge adapted to engage with the first and second lamp pins, respectively, when the rotor is in the second position.

3. The socket assembly according, to claim 1, further comprising a mounting structure for coupling the housing to a panel.

4. The socket assembly according to claim 3, wherein the mounting structure is sized and configured to engage the panel by one of snapping in from above, snapping in from below or slidably engaging.

5. The socket assembly according to claim 3, wherein the mounting structure is adapted to mount through a hole formed in the panel, the mounting structure having first, second and third snaps adapted to secure the mounting structure to the panel when inserted through the hole.

6. The socket assembly according to claim 5, wherein the hole defines a second axis, each of the first, second and third snaps defines an axis about parallel to the second axis, wherein one of the first, second and third snaps is adapted such that the snap is about 180 degrees of rotation about a third axis parallel the second axis relative to the remaining two snaps.

7. The socket assembly according to claim 5, wherein the mounting structure is snap-on attachable to the housing from above the panel.

8. The socket assembly according to claim 3, wherein the housing is attachable to the mounting structure.

9. The socket assembly, according to claim 3, wherein the second conductor abuts the mounting structure within an inner space of the housing.

10. The socket assembly according to claim 3, wherein the second conductor includes a rounded dimple adapted for insertion into a complimentary space formed in the mounting structure.

11. The socket assembly according to claim 1, the housing further comprising:

a first retaining member extending from an inside surface of the housing, the first retaining member being adapted to retain the first end of the first conductor; and a second retaining member extending from the inside surface of the housing, the second retaining member adapted to retain the second end of the first conductor.

12. The socket assembly according to claim 11, wherein the first and second retaining members each include approximately parallel first and second protrusions to retain the first and second ends, respectively, of the first conductor between the first and second protrusions.

13. The socket assembly according to claim 12, wherein first protrusion is positioned closer to the axis of rotation of the rotor than the second protrusion, wherein the first and second protrusions each define a length, wherein the length of the first protrusion is less than the length of the second protrusion.

14. The socket assembly according to claim 1, wherein the second conductor includes a spring-like member adapted to electrically contact the first conductor when the rotor is in the second position.

15. The socket assembly according to claim 1, wherein the first conductor includes a rounded dimple adjacent to the second conductor.

16. The socket assembly according to claim 15, wherein the second conductor includes a spring.

17. The socket assembly according to claim 16, wherein the spring is an elongated metallic member having a free end.

18. The socket assembly according to claim 17, wherein the elongated metallic spring member includes a projection adjacent to the first conductor.

19. The socket assembly according to claim 18, wherein the projection is another curved dimple.

20. The socket assembly according to claim 17, wherein the free end is in sliding engagement with another elongated member of the second conductor.

21. The socket assembly according to claim 17, wherein the rotor includes a flange along at least one radial partition of the rotor adapted to abut the free end of the second conductor.

22. The socket assembly according to claim 21, wherein the flange defines an opening such that a portion of the free end of the second conductor contacts the first conductor through the opening when the rotor is in the second position.

23. The socket assembly according to claim 1, wherein the second conductor includes a spring-like portion and the rotor includes a flange along at least one radial partition of the rotor adapted to abut the spring-like portion of the second conductor.

24. The socket assembly according to claim 20, wherein the flange defines an opening such that the spring-like portion of the second conductor contacts the first conductor through the opening when the rotor is in the second position.

25. The socket assembly according to claim 1, wherein the rotor includes at least one radial protrusion adapted to engage the first conductor so that the first conductor contacts the second conductor when the rotor is in the second position.

26. The socket assembly according to claim 1, wherein the rotor includes a flange along at least one radial partition of the rotor, the flange being adapted to abut the second conductor so that the second conductor is displaced from the first conductor and thus electrically isolated from the first conductor when the rotor is in the first position.

27. The socket assembly according to claim 26, wherein the flange defines an opening such that the second conductor contacts the first conductor through the opening when the rotor is in the second position and thus electrically communicating the first and second conductors.

28. The socket assembly according to claim 1 wherein the rotor includes a hole extending therethrough, the hole having a center about centered along the axis of rotation of the rotor when secured within the housing, and wherein an inner surface of the housing includes a cam extending through the hole of the rotor, the cam being adapted to engage the rotor such that the rotor is rotatable about the axis of rotation of the rotor when secured within the housing.

29. The socket assembly according to claim 28, wherein the rotor includes a flange extending inwardly towards the center of the hole, and the cam includes first and second retaining members extending outwards from the cam in opposite directions, the first and second retaining members being in sliding engagement with the flange thereby securing the rotor within the housing.

* * * * *